US005316311A

United States Patent [19]

Lee

[11] Patent Number: 5,316,311

[45] Date of Patent: * May 31, 1994

[54] ARTICLES OF PLAY FOR USE IN THE GAME OF CATCH

[75] Inventor: Miryoung Lee, West Covina, Calif.

[73] Assignee: Many Amazing Ideas, Inc., Walnut, Calif.

[ * ] Notice: The portion of the term of this patent subsequent to Feb. 4, 2009 has been disclaimed.

[21] Appl. No.: 828,746

[22] Filed: Jan. 31, 1992

Related U.S. Application Data

[63] Continuation-in-part of Ser. No. 490,301, Mar. 8, 1990, Pat. No. 4,995,617, and a continuation-in-part of Ser. No. 642,278, Jan. 15, 1991, Pat. No. 5,085,442.

[51] Int. Cl.[5] ..... A63B 67/00

[52] U.S. Cl. ..... 273/346; 273/412; 273/DIG. 30

[58] Field of Search ..... 273/346, 412, DIG. 30

[56] References Cited

U.S. PATENT DOCUMENTS

| | | | |
|---|---|---|---|
| 3,032,345 | 5/1962 | Lemelson | 273/346 |
| 3,857,566 | 12/1974 | Lemelson | 273/346 |
| 3,999,748 | 12/1976 | Clarke | 273/346 |
| 4,017,076 | 4/1977 | Bai | 273/346 |
| 4,735,420 | 4/1988 | Seidler | 273/346 X |
| 4,995,617 | 2/1991 | Lee | 273/346 |
| 5,080,374 | 1/1992 | Yu | 273/346 |
| 5,085,442 | 2/1992 | Lee | 273/346 |

FOREIGN PATENT DOCUMENTS

| | | |
|---|---|---|
| 59911 | 12/1985 | Rep. of Korea . |
| 22590 | 12/1989 | Rep. of Korea . |

*Primary Examiner*—William H. Grieb
*Attorney, Agent, or Firm*—Lieberman & Nowak

[57] ABSTRACT

Articles of play for use with the game of catch include a ball covered with a hook and loop fastening material and a multi-layer catcher's mitt with a front layer also covered in a mating material. The multi-layer mitt includes a rigid rear layer, a flexible layer, and front layer of a hook and loop fastening material.

3 Claims, 9 Drawing Sheets

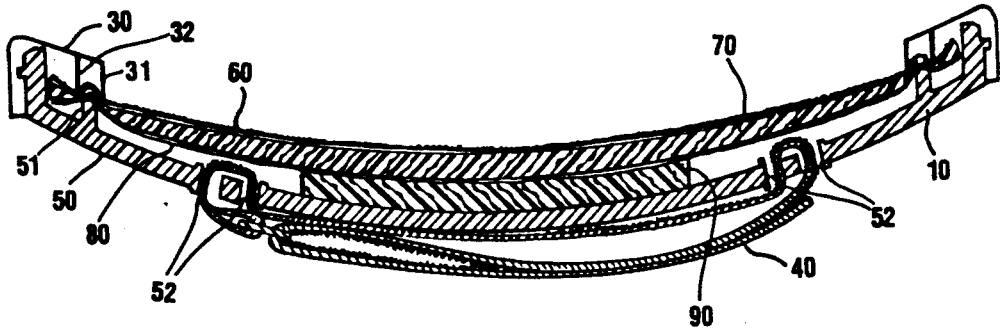
FIG.4A
FIG.4B
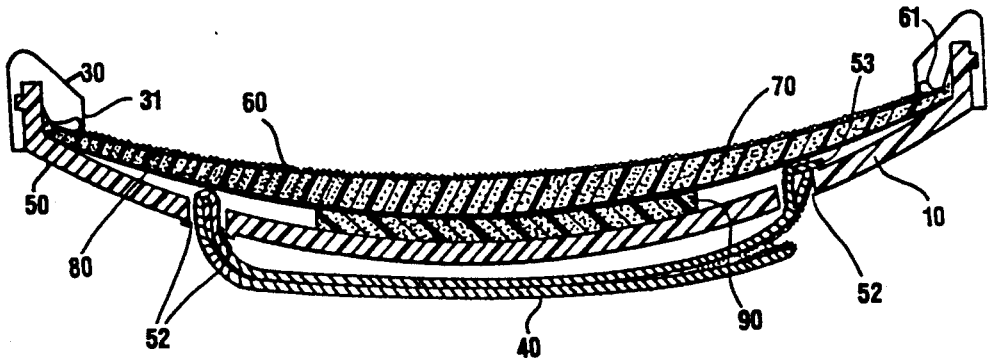

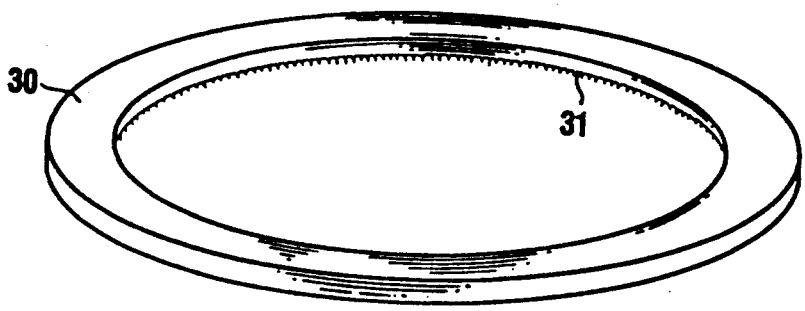
FIG. 7A
FIG. 7B
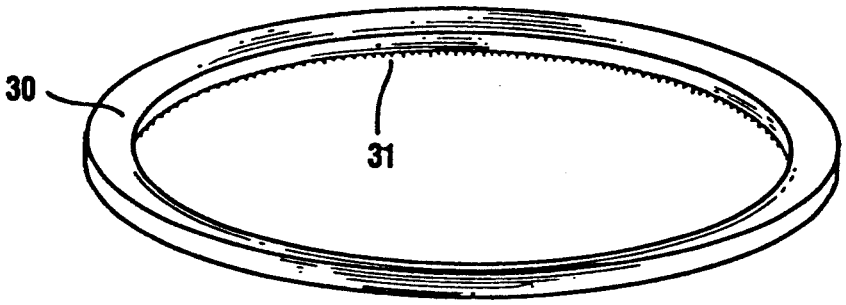

ARTICLES OF PLAY FOR USE IN THE GAME OF CATCH

FIELD OF THE INVENTION

This application is a continuation-in-part of U.S. patent application Ser. No. 490,301, filed Mar. 8, 1990, now U.S. Pat. No. 4,995,617, issued Feb. 26, 1991, and U.S. patent application Ser. No. 642,278, filed Jan. 15, 1991, now U.S. Pat. No. 5,085,442, issued Feb. 4, 1992, the contents of which are hereby incorporated by reference. This invention relates to articles of sport and play and, more particularly, to unique articles for playing the game of catch, which articles are particularly useful for both young children and adult players.

BACKGROUND OF THE INVENTION

The game of catch has been played since antiquity, both as a form of play and, in more recent times, as part of a sport such as baseball, etc. As is well known, the game is played by tossing a ball (or any similar article) back and forth between two or more players, who may catch the ball with their bare hands, or with the aid of a baseball glove, or the like.

Although throwing and catching an object, such as a ball, is enjoyable and easily mastered by older children and adults, a surprising amount of coordination is required to successfully play the game. This coordination is often lacking in children in their early stages of physical development Although younger children are generally eager to attempt playing the game of catch or related sports activities, they often become frustrated in their efforts due to their inability to successfully catch the ball.

One object of the subject invention is to simplify the game of catch so that it may be easily played by younger children Another object of the instant invention is to simplify the game of catch by providing play articles which permit a young child to easily catch a thrown object, such as a ball, through use of a unique catching aid.

In accordance with one aspect and feature of the subject invention, unique play articles are provided for playing the game of catch. These articles include a catcher's aid (typically glove type) with a front surface covered in a hook and loop type fastening material such as VELCRO (registered trademark of The Velcro Manufacturing Co.), along with a ball having a surface area covered in similar material to permit the ball to be easily caught by the catcher's glove by the attachment action of the hook and loop type fastening material.

Prior art patents exist in which mating sections of VELCRO, or similar material, are used to facilitate adherence of an object to the front surface of a play article.

One of the earliest of patents is U.S. Pat. No. 3,032,345, issued May 1, 1962 to Jerome H. Lemelson. This patent is directed to a dart game in which the front surface of a dart, and the front surface of a target, were covered with VELCRO material When the dart is thrown at the target, the dart attaches to the target, simulating play as with an actual game of darts, but without the danger of sharpened steel dart tips.

A second Lemelson patent, U.S. Pat. No. 3,857,566, issued Dec. 31, 1974, is directed to solving the problem of a dart disengaging from the target area due to the inherent bounce of the dart upon impact on the target. The "bounce problem" was addressed in the '566 patent by stretching VELCRO material over a frame, which frame maintained a predetermined distance between the VELCRO material and the wall on which the frame was to be hung. During the initial impact stage of the head of the dart against the flexible VELCRO material, the dart decelerates, without bounce, thereby preventing disengagement of the dart from the target.

Although the '566 patent addressed the "bounce problem", it did so by providing a frame structure over which the VELCRO material was stretched. Such a solution is clearly unsatisfactory for play articles to be used in the game of catch or other baseball like games.

A similar patent directed specifically to the game of catch is U.S. Pat. No. 3,999,748, issued to William A. Clarke on Dec. 28, 1976. This patent is directed to play articles useful in the game of catch, comprising a ball coated with VELCRO like material, and a mitt or glove having an outer face also covered with a VELCRO like material. The mitt or glove is a multi-layer device, consisting of a facing layer of VELCRO material, a flexible textile backing layer, and an intermediate plastic foam layer sandwiched between the backing layer and the facing layer. The entire multi-layer device is flexible in nature and devoid of rigid parts, which construction (although not mentioned in the '748 patent), might tend to reduce the "bounce problem". However, the flimsy construction of the mitt described in the '748 patent would prohibit adherence of any "hard thrown" balls due to inadequate padding and, moreover, the flexible nature of the entire glove would result in constant movement on the hand, making the glove very difficult for young children to use.

It is, therefore, an object of the subject invention to provide somewhat rigid articles of play for use with the game of catch, which are easily used by young children, while at the same time being completely devoid of the "bounce problem".

It is a further object of the instant invention to provide articles of play for use by young children in the game of catch, which are capable of absorbing the high energy of hard thrown balls without bounce or injury to the hand.

Lastly, it is an object of the instant invention to provide a game of catch which is simple and economical to manufacture.

SUMMARY OF THE INVENTION

Articles of play are provided for use with the game of catch. These articles comprise a ball having at least a portion of its surface defined by a multitude of irregular filamentary formations, such as, for example, by VELCRO. This material will be referred to throughout the specification as hook and loop material or hook and loop fastening means.

In accordance with another feature of the subject invention, a multi-layer mitt is provided for each participant in the game of catch, the mitt including a rear layer, an intermediate flexible layer, and a front layer having at least a portion of its front surface covered with a VELCRO type material. In a preferred embodiment of the subject invention, a plurality of intermediate flexible layers are utilized to better dampen the impact of the ball against the mitt.

It is another feature of the subject invention that the adhesive qualities of the hook and loop material present both on the ball and the multi-layer mitt, permit the game of catch to be readily played by very young individuals lacking advanced physical coordination.

Further, one or more intermediate flexible layers may be employed to eliminate "bounce" when the ball strikes the mitt. These layer(s) additionally provide, in conjunction with the rear layer, extensive hand protection allowing adults to play the game of catch wherein the ball may be thrown with great force and easily caught.

These and other objects and features of the invention will be more fully appreciated from the following detailed description when taken in conjunction with the accompanying drawings

BRIEF DESCRIPTION OF THE DRAWINGS

FIG. 4A is a cross-sectional side view of a first embodiment of the mitt used with the subject invention;

FIG. 4B is a cross-sectional side view of a second embodiment of the mitt used with the subject invention;

FIG. 7A is a perspective view of the top portion of the retaining ring of the first embodiment;

FIG. 7B is a perspective view of the top portion of the retaining ring of the second embodiment;

DETAILED DESCRIPTION OF THE INVENTION

The subject invention will now be described in terms of its preferred embodiments. Although the preferred embodiments are depicted, they are not to be construed as limiting.

Figure 1:
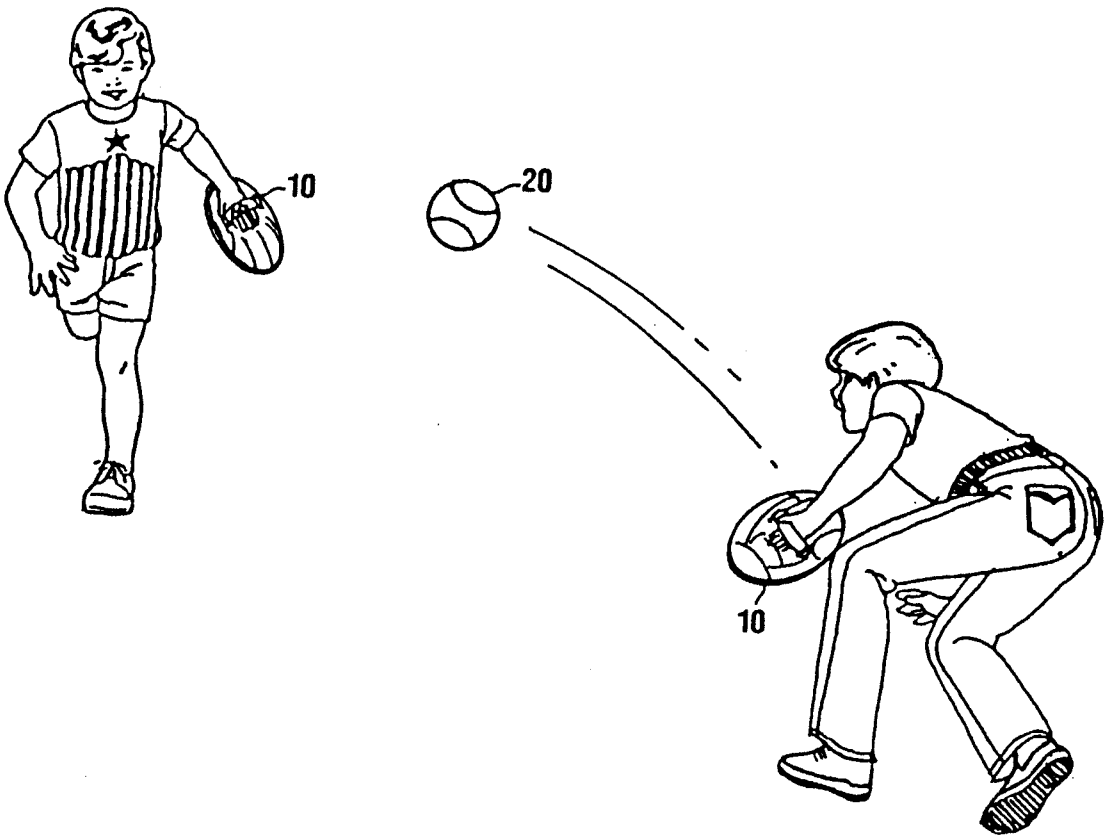
FIG. 1 illustrates use of the subject invention by children for playing the game of catch.
Figure 2A:
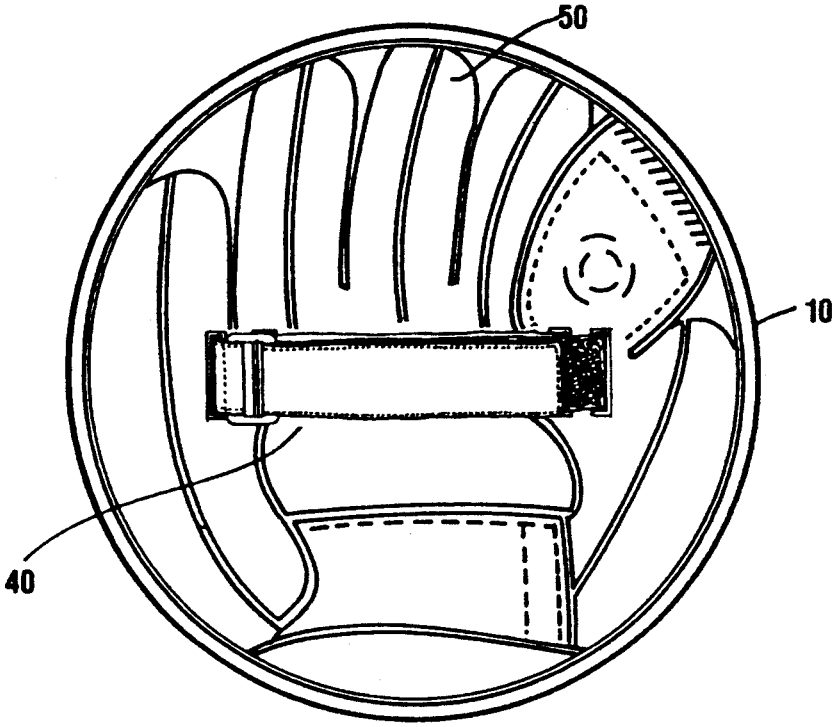
FIG. 2A is a rear view of a first embodiment of the mitt used with the subject invention.
Figure 2B:
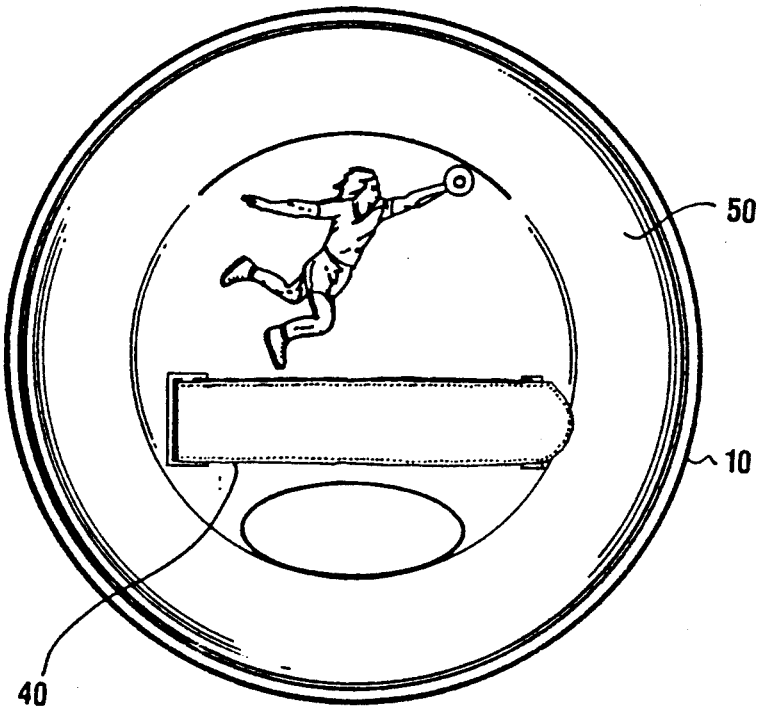
FIG. 2B is a rear view of a second embodiment of the mitt used with the subject invention.

Referring now to FIG. 1, there is shown two young children engaging in a game of catch, while using articles of play in accordance with the subject invention. Each child has on his left hand the "catcher's mitt" 10 which, as described above, has a front surface covered with a multitude of irregular filamentary formations such as VELCRO material. Ball 20 may be covered with a mating surface of irregular filamentary formations, such as VELCRO strips or, preferably, an entire VELCRO covering so that the ball will adhere to the catcher's mitt when thrown by each child.

FIGS. 2A, 2B and 3A, 3B illustrate a front and back view of the catcher's mitt. FIGS. 2A, 3A, 4A, 5A, 6A, 7A and 8A refer to a first embodiment of the subject mitt and FIGS. 2B, 3B, 4B, 5B, 6B, 7B and 8B refer to a second embodiment of the subject mitt. The rear layer 50 of the mitt is preferably made of a strong material that makes the mitt nearly impossible to break under strong impact. At the present time, the preferred material is a plastic polymer, such as polyethylene. Typically, the rear layer 50 is concave and rigid. The term "rigid" is to include non- or minimally-flexible materials, as well as flexible materials made resistant to flexing by incorporating a support. The essence of the rear layer is that it has an overall resistance to flexibility so as to prevent twisting of the mitt upon being impacted by the projectile to be caught. It is to be understood that the material may have formed in the surface thereof, the shape of an actual catcher's mitt or other aesthetically appealing shapes.

Figure 3A:
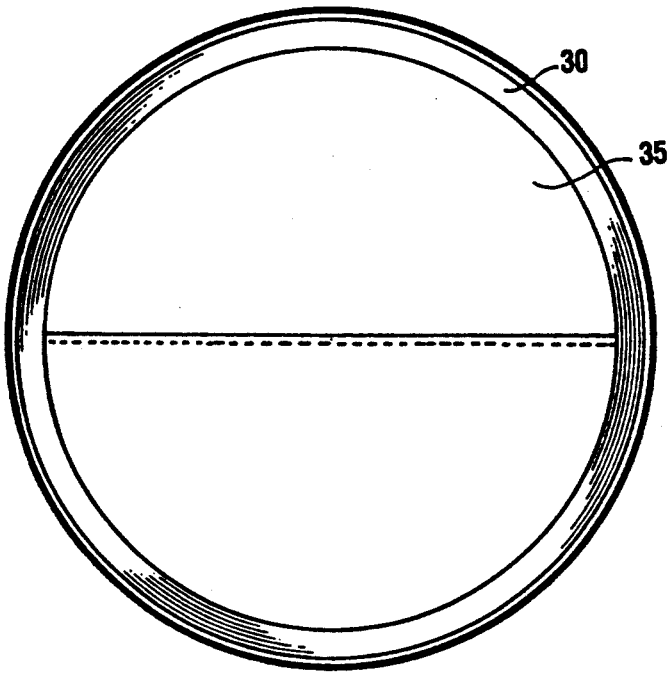
FIG. 3A is a front view of a mitt used with the subject invention.
Figure 3B:
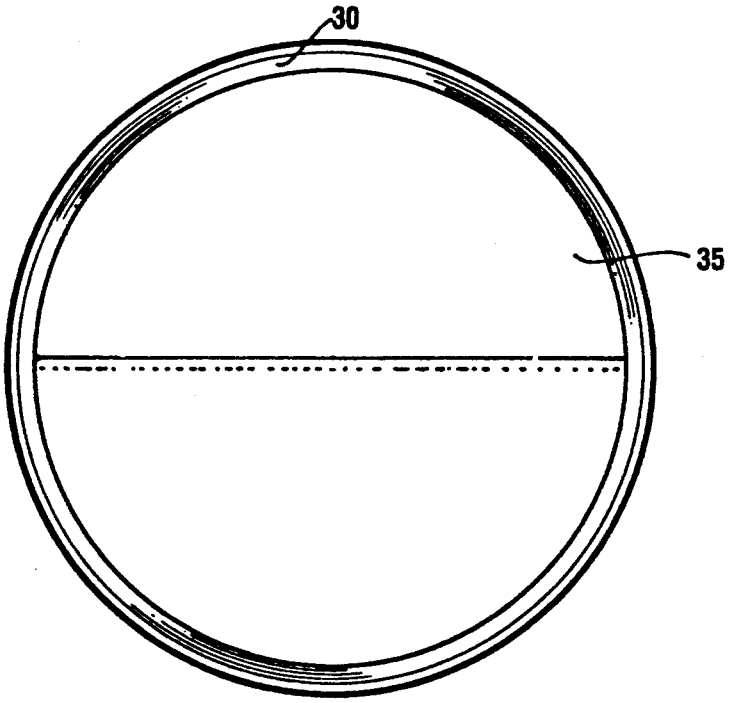
FIG. 3B is an alternative front view of a mitt used with the subject invention.

The player engages the mitt by inserting his, or her, hand under the handle 40. Preferably, the handle is adjustable to fit hands of various sizes. In a preferred embodiment, the handle comprises a strap which passes through the rigid rear layer. The handle is typically adjusted by a hook and loop or other type closure. FIGS. 3A and 3B illustrate the front surface of the mitt which, as described above, has a covering of hook and loop material, such as VELCRO, at area 35 covering the entire surface of the mitt. This covering is retained in place in a manner described below, with the edges of the hook and loop material being restrained by retaining ring 30.

FIGS. 4A and 4B illustrate cross-sectional side views of the mitt. As described, ball 20 is completely covered with a hook and loop material layer for adhesion to the corresponding hook and loop material front surface of the catcher's mitt. This front surface typically consists of a layer of VELCRO material 60 behind which is inserted a foam layer 70, preferably of a thickness approximating one-third inch, which foam layer is backed by a fabric layer 80. Any suitable fabric may be employed. For example, fabrics such as nylon, polyester, cotton or silk may be utilized. Beneath the fabric layer 80 preferably exists a second flexible foam layer 90, which typically occupies an area approximately 3.5 inches square, and is arranged to lie within the approximate center of the catcher's mitt. The foam material utilized for both layer 90 and layer 70 is preferably a polyurethane foam. Layers 70 and 90 may be combined into a single foam layer. The total distance between layer 60 and the rear layer 50 of the mitt, is typically in the range of between about one-fourth and about two inches. Similarly, if the mitt is circular, its diameter is typically between about six and about twelve inches.

The preferred embodiment, the mitt 10 is constructed so as to eliminate the use of glue to adhere the layers both to each other and to the rigid rear layer 50. This improvement results in a substantial savings in both time and material over the construction described in the parent patent applications.

Foam layer 90, fabric layer 80, foam layer 70 and hook and loop material layer 60 are stacked in the rigid rear layer 50 of mitt 10. The layers may optionally be sewn to handle 40 to support them in place. Most preferably, the handle is an adjustable strap. In FIG. 4A, a hook and loop material strap serves as a handle 40. The strap is woven in and out of the two pairs of holes 52 that are made in the rear layer 50 of the mitt. The strap is then woven through the holes 52 in the manner depicted to secure the handle 40 of the rear layer 50. An alternate method of looping the strap through the holes is depicted in FIG. 4B. FIG. 4B depicts an embodiment having three holes 52 in the rear layer 50. On the side having a single hole 52, a loop 53 is used to prevent the strap from passing through the holes 52. The loop 53 typically is configured so that the strap can pass therethrough while being of sufficient dimension to defy passing through the hole 52.

Figure 8A:
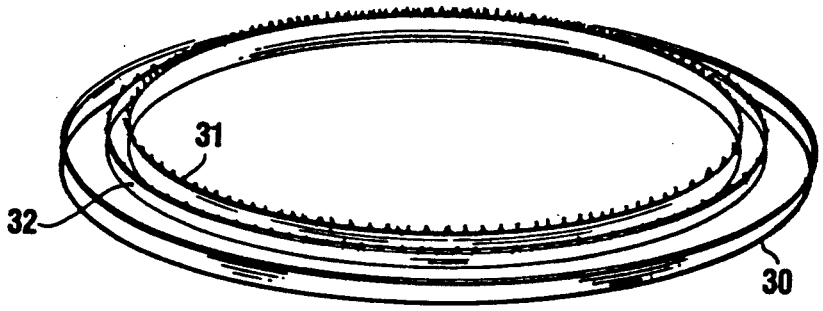
FIG. 8A is a perspective view of the bottom of the retaining ring of the first embodiment.
Figure 8B:
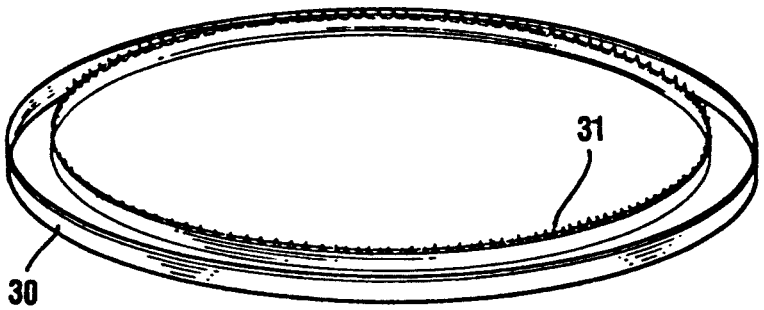
FIG. 8B is a perspective view of the bottom of the retaining ring of the second embodiment.

The layers of mitt 10 are held in place by retaining ring 30. Preferably, retaining ring 30 has a plurality of teeth 31 which grip the hook and loop material layer 60 securely. In FIG. 4A and 8A, the to further assist the retaining ring in securing the layers in place, rigid rear layer 50 has a plurality of raised protrusions 51 that are preferably arranged in a pattern conforming to that of the inner edge of retaining ring 30, but defining a slightly larger circumference. For example, if the inner edge of retaining ring 30 is circular and has a radius of three and one-quarter inches, then the arrangement of raised protrusions 51 is also circular with the inner edge of the raised protrusions 51 defining a radius of three and three-eights inches. By having this configuration, the layers are further secured between the inner edges of retaining ring 30 and the raised protrusions 51. The raised protrusions 51 may take the form of teeth and act in a manner similar to teeth 31 in gripping the layer(s) located thereabove.

A further improvement over the parent patent is the presence of a second ring of teeth 32 radially placed around the retaining ring 30. Preferably, this second ring of teeth 32 defines a circumference slightly larger than that of the raised protrusions 51. This configuration provides three distinct loci of contacts for engaging the layers.

Figure 5A:
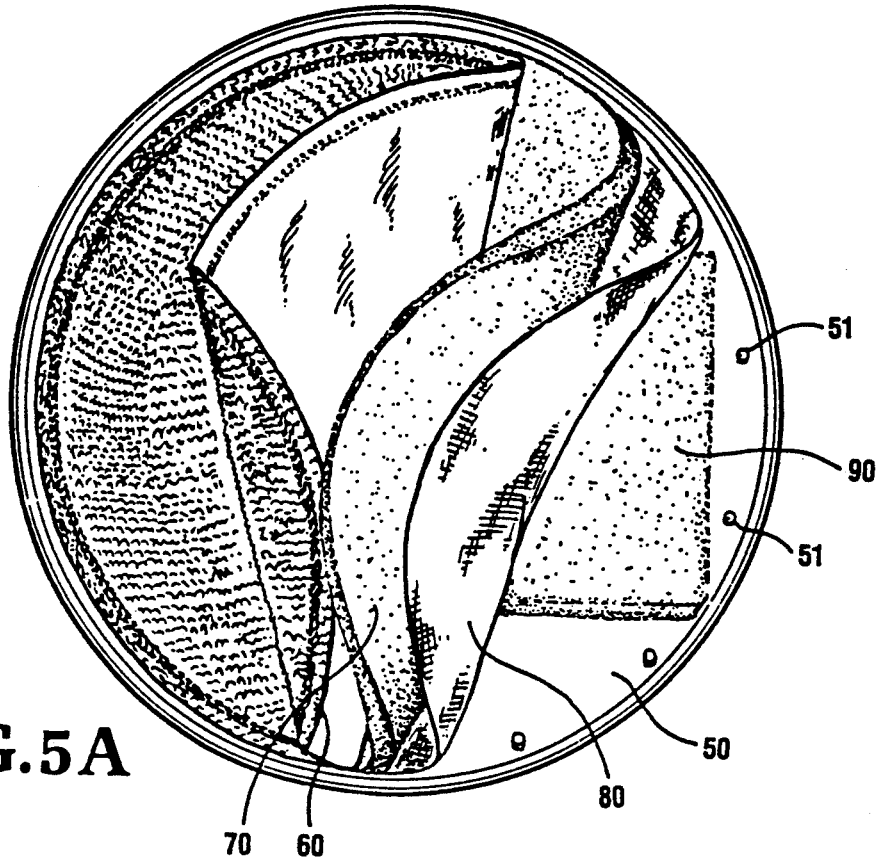
FIG. 5A is a top view of a first embodiment of the mitt used with the subject invention wherein the layers of hook and loop material, foam, cloth, and foam have been exposed.
Figure 5B:
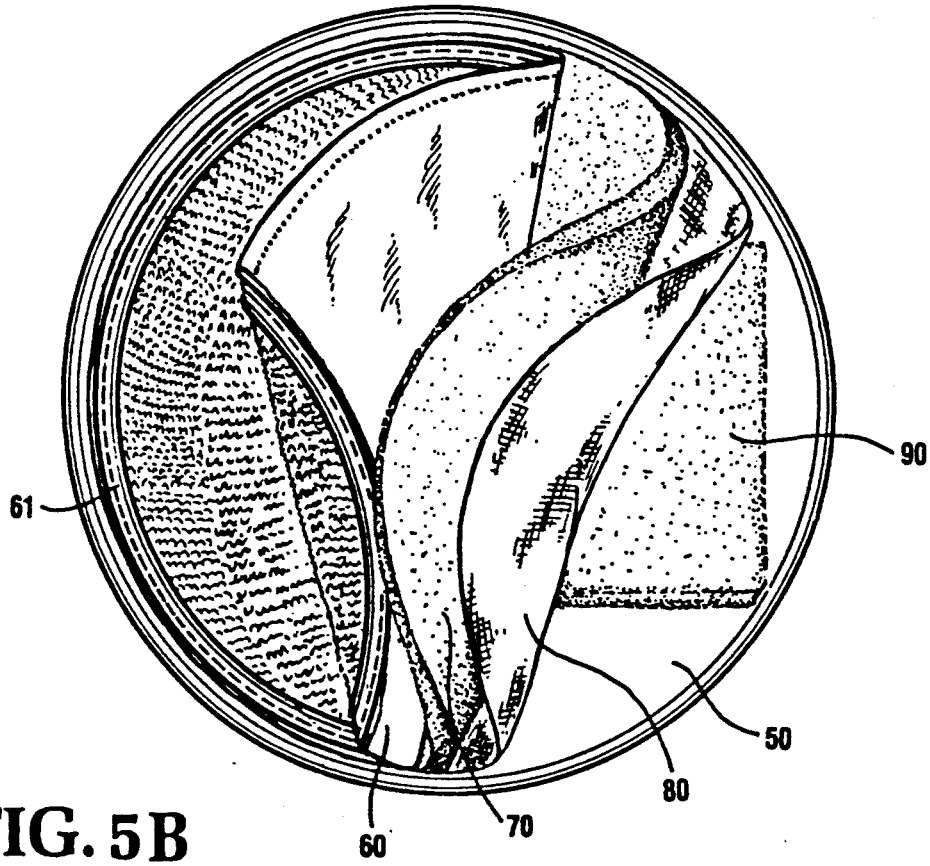
FIG. 5B is a top view of a second embodiment of the mitt used with the subject invention wherein the layers of hook and loop material, foam, cloth, and foam have been exposed.
Figure 6A:
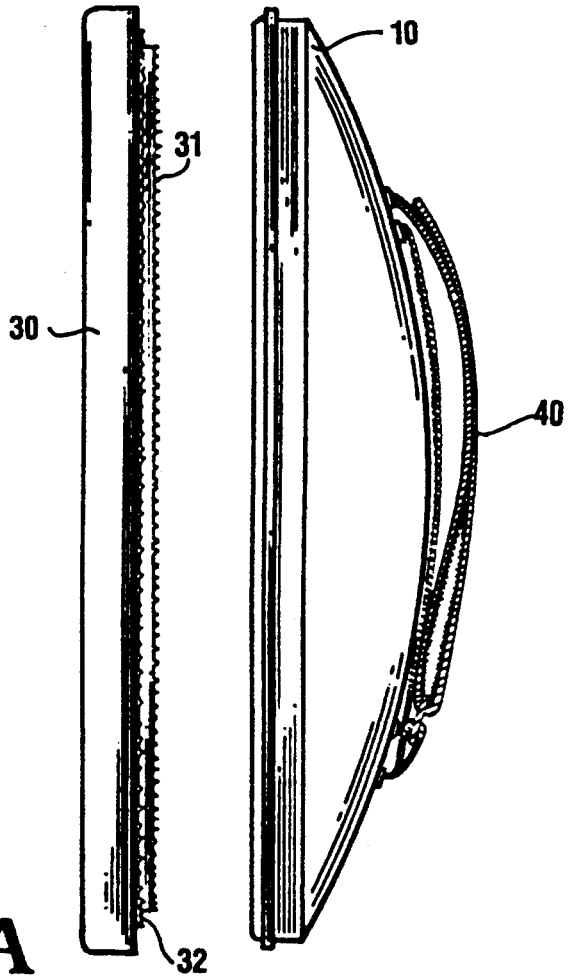
FIG. 6A is a side view of a first embodiment of the mitt of the subject invention having its retaining ring removed.
Figure 6B:
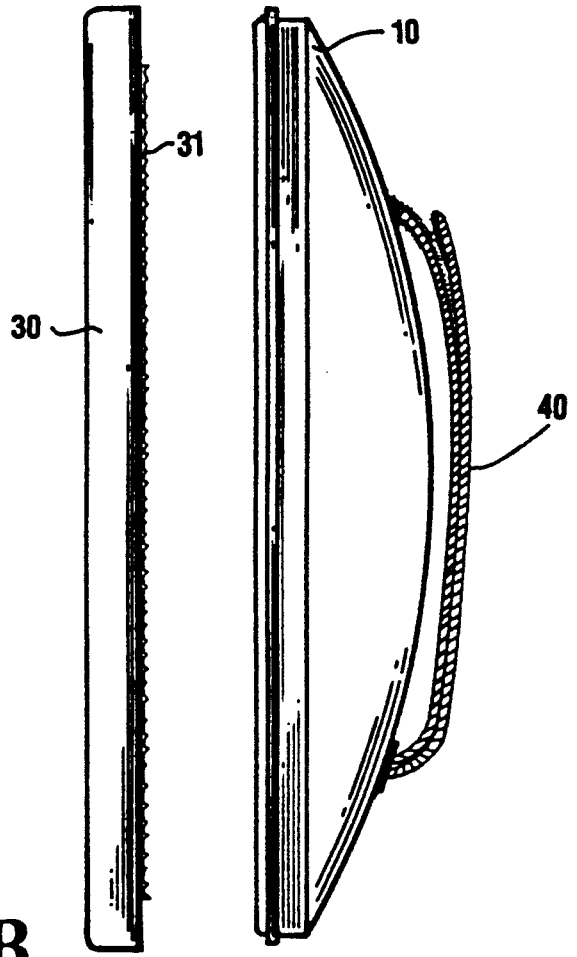
FIG. 6B is a side view of a second embodiment of the mitt of the subject invention having its retaining ring removed.

To further aid in securing the layers (as is depicted in FIGS. 4B and 5B), strips 61 may be attached to the perimeter of hook and loop material layer 60. These strips may be of any suitable material, but preferably are made of a plastic "piping". This piping typically has a lollipop shaped cross-section. The flat portion (corresponding to the stick of the lollipop) may be sewn to the hook and loop material layer 60 near its periphery. The round portion (the candy portion of the lollipop) is located toward the radial center of the hook and loop layer 60, with the round portion acting to engage the retaining ring. Preferably, these strips 61 are of a width that fits between the inner edge of the retaining ring and the edge of the rigid rear layer 50. As an improvement over the parent patents, the strips may be sewn to the hook and loop material layer 60, the foam layer 70 and the fabric layer 80 to form a single insert that may be inserted into the rear layer 50.

Accordingly, the preferred method of manufacture comprises the steps of:

(b) placing foam layer 90 into the concave portion of rigid rear layer 50 above handle 40;

(a) attaching handle 40 through the openings in rigid rear layer;

(c) inserting an insert which is formed by:

(i) placing foam layer 70 on top of fabric layer 80;

(ii) placing hook and loop material layer 60 on top of foam layer 70; and (iii) sewing strips 61 to the radial periphery of hook and loop material layer 60 so that the sewing connects layers 80, 70, and 60; and (d) snapping retaining ring 30 upon the top of hook and loop material layer 60 and onto the rigid rear layer 50 so as to secure all layers to the rigid rear layer 50 thereby forming mitt 10.

The above method of manufacture is only a guideline and various steps may be combined or carried out in a different order. For example, in the first preferred embodiment the fabric layer 80, foam layer 70 and hook and loop layer 60 may be inserted individually without sewing or attaching strips 61.

An alternative method of construction includes layer 90 being glued to rear layer 50 of mitt 10 and, thereafter, gluing cotton fabric layer 80 over layer 90, and also gluing layer 80 to the rear layer 50 of mitt 10. Foam layer 70 is sewed to cotton layer 80 and, thereafter, hook and loop layer 60 is sewed to foam layer 70. Use of the cotton fabric substantially prevents the foam layers from separation, and makes the foam layers much more durable under repeated impacts from ball 20.

FIG. 6 illustrates a top view of a mitt in which the layers of hook and loop material 60, foam 70, cloth 80 and foam 90 have been exposed. Around the inner circumference of the rigid rear layer 50 is a series of raised protrusions 51 which aid in holding the upper cloth, foam and hook and loop material layers in place.

FIGS. 7A and 7B illustrate side views of the catcher's mitt illustrating handle 40, mitt 10 and retaining ring 30. The purpose of retaining ring 30 is to ensure that the hook and loop material layer does not separate when ball 20 is removed from mitt 10. The preferred retaining ring 30 has a plurality of teeth (31 and/or 32) which are on the portion of the ring that contacts the hook and loop material layer to further secure this layer to the rigid rear layer 50.

Various portions of the mitt or ball may be made of assorted colors, and/or made of phosphorescent material for exciting night-time play.

The advantage of the subject invention is the use of foam layers 70 and/or 90, which layer, or layers, are designed to substantially absorb any impact by the ball during the game of catch, and thus prevent disengagement between the ball and the mitt. Since the foam layer(s) absorb approximately 60% of the impact of the ball, the ball consistently adheres to the hook and loop material front layer of the catcher's mitt, thereby ensuring a successful game of catch for young children and coordination impaired individuals, as well as the physically gifted.

In addition, the foam layer(s) eliminate any "bounce problem", while providing adequate hand protection so that the inventive articles of play can accommodate hard thrown balls fielded by adult players.

The foregoing disclosure and description of the invention is illustrative and explanatory thereof and various changes in the size, shape and materials, as well as in the details of the illustrated constructions, may be made within the scope of the appended claims without departing from the spirit in the invention. As such, the invention is only to be limited by the claims which follow and their equivalents.

What is claimed is:

1. A mitt for use with the game of catch, which comprises:

(a) a rigid rear layer;

(b) an intermediate flexible layer;

(c) a front layer having substantially all its front surface defined by a multitude of irregular filamentary formations, the flexible layer occupying a surface area less than the surface area of the rear layer; and (d) a retaining ring having an inner-toothed edge, the inner-toothed edge extending over a portion of the front layer to prevent the front layer from separating from the intermediate flexible layer, the teeth on the inner toothed edge being formed as a plurality of concentric rings.

2. A mitt of claim 1, wherein the plurality is two.

3. A mitt of claim 2, wherein the first ring of teeth defines a circumference smaller than that of the raised protrusions and the second ring of teeth defines a circumference larger than that of the raised protrusions.

* * * * *